United States Patent [19]

Fitzgerald et al.

[11] 4,350,759

[45] Sep. 21, 1982

[54] ALLYL AMINE POLYMERIC BINDERS FOR PHOTOGRAPHIC EMULSIONS

[75] Inventors: Maurice J. Fitzgerald, Canton; Thomas E. Platt, Manchester, both of Mass.

[73] Assignee: Polaroid Corporation, Cambridge, Mass.

[21] Appl. No.: 249,065

[22] Filed: Mar. 30, 1981

[51] Int. Cl.[3] ..... G03C 1/72

[52] U.S. Cl. ..... 430/630; 430/627

[58] Field of Search ..... 430/627, 630

[56] References Cited

U.S. PATENT DOCUMENTS

| | | | |
|---|---|---|---|
| 2,949,442 | 8/1960 | Clavier et al. | 430/627 |
| 3,186,973 | 6/1965 | Maeder | 430/627 |
| 3,396,030 | 8/1968 | Haas | 96/114 |
| 3,479,186 | 11/1969 | Taylor et al. | 96/114 |
| 3,681,079 | 8/1972 | Fitzgerald | 96/114 |
| 3,709,690 | 1/1973 | Cohen et al. | 430/627 |
| 3,713,834 | 1/1973 | Fitzgerald | 96/114 |
| 3,721,565 | 3/1973 | Fitzgerald | 96/114 |
| 3,746,548 | 7/1973 | Fitzgerald et al. | 96/113 |
| 3,799,781 | 3/1974 | Fitzgerald | 96/113 |
| 3,799,782 | 3/1974 | Fitzgerald | 96/113 |
| 3,816,129 | 6/1974 | Fitzgerald | 96/114 |
| 3,832,185 | 8/1974 | Fitzgerald | 96/114 |
| 3,852,073 | 12/1974 | Fitzgerald | 96/114 |
| 3,861,918 | 1/1975 | Fitzgerald | 96/114 |
| 3,879,205 | 4/1975 | Fitzgerald et al. | 96/114 |
| 4,022,623 | 5/1977 | Fitzgerald et al. | 96/114 |
| 4,089,688 | 5/1978 | Fitzgerald | 96/114 |
| 4,120,727 | 10/1978 | Fitzgerald | 96/114 |
| 4,131,471 | 12/1978 | Fitzgerald | 96/114 |

FOREIGN PATENT DOCUMENTS

| | | | |
|---|---|---|---|
| 570499 | 2/1959 | Canada | 430/627 |
| 843501 | 8/1960 | United Kingdom | 430/627 |

*Primary Examiner*—Mary F. Downey

*Attorney, Agent, or Firm*—Louis G. Xiarhos

[57] ABSTRACT

A photosensitive silver halide emulsion wherein the emulsion binder comprises an allyl amine polymer or copolymer.

6 Claims, No Drawings

ALLYL AMINE POLYMERIC BINDERS FOR PHOTOGRAPHIC EMULSIONS

In general, practical uses of photosensitive photographic emulsions require a binder of a suitable, transparent material that accommodates coating and subsequent drying to form a flexible layer. The binder further must provide a medium that features the property of colloid protection; the emulsion binder must be able to form absorption layers on microcrystals of silver halide which permit a stable suspension to be obtained and do not prevent growth of the silver halide microcrystals during physical ripening. To avoid undesirable interference, the emulsion medium preferably should be absent photographic activity, or at least exhibit a constant photographic activity for which suitable compensation can be designed. Solubility in water solution also is required.

Gelatin continues to enjoy a preeminent position in photographic emulsion preparation. Nevertheless, it exhibits known disadvantages. It is difficult to produce gelatin of consistent quality and with nonvarying physical and photographic properties. Most of its properties are subject to deterioration in storage, due to bacterial decomposition, or, in the photographic process, due to hydrolysis. In addition, gelatin contains varying quantities of a plurality of naturally occurring impurities, depending on its source, and, also is subject to dimensional changes when exposed to fluctuating conditions of temperature and moisture.

Hence, considerable research effort has been expended in attempts to replace gelatin with alternate emulsion vehicles. Now, according to the present invention, a synthetic polymer photographic emulsion binder has been discovered which comprises an allyl amine polymer. These novel synthetic polymers are not susceptible to the deficiencies of gelatin materials outlined above and may be utilized to replace part or all of the gelatin in photosensitive silver halide emulsions.

The synthetic polymer binder of the present invention comprises an allyl amine polymer having repeating units represented by the formula:

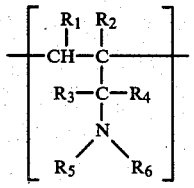

wherein: $R_1$ is hydrogen, lower alkyl, or halogen; $R_2$ is hydrogen, lower alkyl, halogen, or cyano; $R_3$ and $R_4$ are independently selected from hydrogen and lower alkyl; and $R_5$ and $R_6$ are independently selected from hydrogen, lower alkyl, lower cycloalkyl, and phenyl; with the proviso that $R_3$ and/or $R_4$ and/or $R_5$ and/or $R_6$ may be chemically joined to form a 3 to 8 membered heterocyclic ring structure.

Particularly preferred are polymeric units wherein $R_1$ is hydrogen; $R_2$ is hydrogen, methyl, or chloro; $R_3$ and $R_4$ are independently selected from hydrogen and methyl; and $R_5$ and $R_6$ are independently selected from hydrogen and methyl, or are chemically joined to form a 6 membered heterocyclic ring structure.

Typical examples of monomers useful in preparing synthetic polymer binders of the present invention include:

1. $CH_2{=}CH{-}CH_2{-}NH_2$
allylamine

2. $CH_2{=}C(CH_3){-}CH_2{-}NH_2$
methallylamine

3. $CH_3{-}CH{=}C(C{\equiv}N){-}CH_2{-}NH_2$
1-amino-2-cyano-2-butene

4. $CH_2{=}CH{-}CH_2{-}NH{-}C_6H_5$
N-allylaniline

5. $CH_2{=}CH{-}CH_2{-}N(CH_3){-}C_6H_5$
N-allyl-N-methylaniline

6. $CH_2{=}CH{-}CH_2{-}NH{-}C_6H_{11}$
allylcyclohexylamine

7. $CH_2{=}CH{-}CH_2{-}N(CH_2{-}CH_2){-}O{-}CH_2$
N-allylmorpholine

8. $CH_2{=}CH{-}CH_2{-}N(CH_3){-}CH_2{-}CH_2{-}CH_2{-}O{-}CH_3$
N-(3-methoxypropyl)-N-methylallylamine 9. $CH_2{=}C(Cl){-}CH_2{-}N(CH_2{-}CH_2){-}O{-}CH_2$
N-(2-chloroallyl) morpholine 10. $CH_2{=}C(Cl){-}CH_2{-}N(CH_2{-}CH_2{-}CH_2{-}CH_2{-}CH_2)$
N-(2-chloroallyl) piperidine 11. $CH_2{=}CH{-}CH_2{-}N(CH_3)_2$
N,N-dimethylallylamine Specific examples of preferred monomers include:
N,N-dimethylallylamine;
N-(2-chloroallyl) morpholine;
N-(2-chloroallyl) piperidine; and
methallylamine.

The instant polymers may be homopolymers or interpolymers having, in addition to the repeating polymeric units described above, any compatible repeating unit or various repeating units which are not detrimental to photographic silver halide emulsions and which enhance the water solubility of the resultant polymer. Examples of typical comonomers useful in preparing synthetic polymer binders of the present invention include the following ethylenically unsaturated monomers:

12. $CH_2{=}CH{-}COOH$
acrylic acid

13. $CH_2{=}C(CH_3){-}COOH$
methacrylic acid

14. $CH_2{=}CH{-}COO{-}CH_3$
methyl acrylate

15. $CH_2{=}CH{-}COO{-}CH_2CH_2CH_2OH$
γ-hydroxypropyl acrylate

16. $CH_2{=}CH{-}CO{-}NH_2$
acrylamide

17. $CH_2{=}C(CH_3){-}CO{-}NH_2$
methacrylamide

18. $CH_2{=}CH{-}CO{-}NH{-}CH_2{-}CO{-}NH_2$
acrylamidoacetamide

19. $CH_2{=}C(CH_3){-}CO{-}NH{-}CH_2{-}CO{-}NH_2$
methacrylamidoacetamide

20. 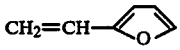
α-vinylfuran

21. 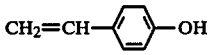
p-hydroxystyrene

22. 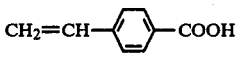
p-carboxystyrene

23. $CH_2{=}CH{-}CO{-}NH{-}CH(COOH){-}CH{-}(CH_3)_2$
N-acryloylvaline

The synthetic polymer binder of the present invention preferably comprises a copolymer of an allyl amine and a suitable comonomer, as defined above. Particularly preferred are copolymers of acrylamide and allyl amine monomers having the general formula:

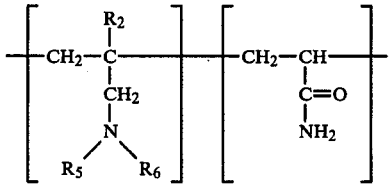

wherein: $R_2$ is hydrogen, methyl, or chloro; and $R_5$ and $R_6$ are independently selected from hydrogen and methyl, or are chemically joined to form a 6 membered heterocyclic ring structure. Preferred polymers are copolymers of acrylamide and N,N-dimethylallylamine; N-(2-chloroallyl) morpholine; N-(2-chloroallyl) piperidine; and methallylamine.

Polymerization of the indicated monomers may be achieved using conventional polymerization techniques.

The following general procedure may be used for preparing photographic emulsions using the above described polymers of the instant invention as the colloid binder.

A water-soluble silver salt, such as silver nitrate, may be reacted with at least one water-soluble halide, such as potassium, sodium, or ammonium bromide, preferably together with potassium, sodium or ammonium iodide, in an aqueous solution of the polymer. The emulsion of silver halide thus-formed contains water-soluble salts, as a by-product of the double decomposition reaction, in addition to any unreacted excess of the initial salts. To remove these soluble materials, the emulsion may be centrifuged and washed with distilled water to a low conductance. The emulsion may then be redispersed in distilled water. To an aliquot of this emulsion may be added a known quantity of a solution of bodying or thickening polymer, such as polyvinyl alcohol having an average molecular weight of about 100,000 (commercially available from E. I. du Pont de Nemours & Company, Wilmington, Del., designated Type 72-60). A surfactant, such as dioctyl ester of sodium sulfosuccinic acid, designated Aerosol OT, (commercially available from American Cyanamid Company, New York, New York), may be added and the emulsion coated onto a film base of cellulose triacetate sheet having a coating of hardened gelatin.

Alternatively, the soluble salts may be removed by adding to the emulsion a solution of polyacid, such as 1:1 ethylene: maleic acid copolymer, and lowering the pH to below 5, thereby bringing about precipitation of the polyacid carrying the silver halide grains along with the precipitate. The resulting precipitate may then be washed and resuspended by redissolving the polyacid at pH 6–7.

The emulsions may be chemically sensitized with sulfur compounds such as sodium thiosulfate or thiourea, with reducing substances such as stannous chloride; with salts of noble metals such as gold, rhodium and platinum; with amines and polyamines; with guaternary ammonium compounds such as alkyl α-picolinium bromide; and with polyethylene glycols and derivatives thereof.

The emulsions of the present invention may also be optically sensitized with cyanine and merocyanine dyes. Where desired, suitable antifoggants, toners, restrainers, developers, accelerators, preservatives, coating aids, plasticizers, hardeners and/or stabilizers may be included in the composition of the emulsion.

The emulsions of this invention may be coated and processed according to conventional procedures of the art. They may be coated, for example, onto various types of rigid or flexible supports, such as glass, paper, metal, and polymeric films of both the synthetic type and those derived from naturally occurring products. As examples of specific materials which may serve as supports mention may be made of paper, aluminum, polymethacrylic acid, methyl and ethyl esters, vinylchloride polymers, polyvinyl acetal, polyamides such as nylon, polyesters such as polymeric film derived from ethylene glycol-terephthalic acid, and cellulose derivaties such as cellulose acetate, triacetate, nitrate, propionate, butyrate, acetate propionate, and acetate butyrate. Suitable subcoats may be provided on the supports, for example, a layer of gelatin, if necessary or desirable for adherence, as is well known in the art.

The preparation of photographic silver halide emulsions employing as binders the allyl amine polymers and copolymers of the present invention is further illustrated by the following nonlimiting examples.

EXAMPLE 1

Copolymer of Acrylamide and N,N-dimethyallylamine 7.11 g. of acrylamide, 1.70 g. of N,N-dimethylallylamine (obtained from Eastman Kodak, Rochester, N.Y., under the designation number 9595), and 0.01 g. of 2,2'-azobis-[2-methylpropionitrile] were dissolved in 60 ml. of dimethylformamide. This solution was then polymerized in a sealed tube at 65° C. for 12 hours under $N_2$. The resultant polymer was separated from solution by filtration and dried under vacuum at 45° C. for 12 hours.

EXAMPLE 2

Copolymer of Acrylamide and N,N-dimethylallyamine

A copolymer product was prepared using the same procedure of Example 1, except that 0.85 g. of N,N-dimethylallylamine was used instead of 1.70 g.

EXAMPLE 3

Copolymer of Acrylamide and N,N-dimethylallylamine

The procedure of Example 1 was followed to prepare the copolymer product, except that 0.43 g. of N,N-dimethylallylamine was used instead of 1.70 g.

EXAMPLE 4

Copolymer of Acrylamide and N,N-dimethylallylamine 6.4 g. of acrylamide and 0.85 g. of N,N-dimethylallylamine were dissolved in 70 mls. of distilled water. The solution was purged with $N_2$. Potassium peroxydisulfate (0.03 g) was added as a catalyst, and then the solution was heated on a water bath at 65° C. overnight. The resultant polymer was precipitated in acetone, collected by filtration and dried.

EXAMPLE 5

Copolymer of Acrylamide and N-(2-chloroallyl) morpholine 7.11 g. of acrylamide, 3.23 g. of N-(2-chloroallyl) morpholine (obtained from PCR, Inc. Gainesville, Florida, under the designation 01-54030-04) and 0.019 g. of 2,2'-azobis-[2-methylpropionitrile] were dissolved in 80 ml. of dimethylformamide. This solution was polymerized in a sealed tube at 65° C. for 12 hours under $N_2$. The resultant product precipitated from solution, was collected by filtration, washed with dimethylformamide, and vacuum dried.

EXAMPLE 6

Copolymer of Acrylamide and N-(2-chloroallyl) piperidine

A polymer product was prepared wherein the procedure of Example 5 was followed, using as reactants 7.11 g. of acrylamide, 3.47 g. of N-(2-chloroallyl) piperidine (obtained from PCR, Inc., under the designation number 01-54040-01) and 0.01 g. of 2,2'-azobis-[2-methylpropionitrile].

EXAMPLE 7

Copolymer of Acrylamide and Methallylamine 7.11 g. of acrylamide and 7.11 g. of methallylamine (obtained from Polysciences, Inc., Warrington, Pennsylvania under the designation number 2480) were dissolved in 80 ml. of dimethylformamide, and then 0.10 g. of 2,2'-azobis-[2-methylpropionitrile] was added. The resultant solution was flushed with nitrogen and sealed in an evacuated glass tube at 65° C. overnight. The resultant polymer precipitated from solution, was collected by filtration, washed with dimethylformamide, and vacuum dried.

EXAMPLES 8-13

Silver halide emulsions employing the polymers of Examples 1-6 as the colloid binders were prepared by the following procedure:

A solution of 4.15 g. of each dry polymer in 266 mls. of distilled water was adjusted to pH 3.0 with dilute nitric acid and maintained at a temperature of 55° C. To this solution 88.0 g. of dry potassium bromide and 1.0 g. of dry potassium iodide were added.

A solution of 55.0 g. of silver nitrate in 500 mls. of distilled water was prepared. From this silver nitrate solution, 100 ml. was rapidly added to the polymer-halide solution and the remainder was added over a period of 22 minutes. Thereafter, the emulsion was ripened for 60 minutes at 55° C., with continuous agitation, at the end of which it was rapidly cooled to below 20° C.

EXAMPLE 14

A silver halide emulsion employing the polymer of Example 7 as the colloid binder was prepared by the following procedure:

A solution of 0.50 g. of dry polymer in 133 ml. of distilled water was adjusted to pH 3.0 with dilute nitric acid and maintained at a temperature of 55° C. To this solution, 44.0 g. of dry potassium bromide and 0.50 g. of dry potassium iodide were added.

A solution of 27.5 g. of silver nitrate in 250 ml. of distilled water was prepared. From this silver nitrate solution, 50 ml. was rapidly added to the polymer-halide solution and the remainder was added over a period of 11 minutes. Thereafter, the emulsion was ripened for 91 minutes at 55° C., with continuous agitation, at the end of which it was rapidly cooled to below 20° C.

COMPARATIVE EXAMPLE 15

A control silver halide emulsion employing gelatin on the colloid binder was prepared by following the procedure:

A solution of 4.15 g. of dry gelatin in 266 mls. of distilled water was adjusted to pH 6.3 with dilute nitric acid and maintained at a temperature of 55° C. To this solution, 44.0 g. of dry potassium bromide and 0.50 g. of dry potassium iodide were added.

A solution of 55.0 g. of silver nitrate in 500 mls. of distilled water was prepared. From this silver nitrate solution, 100 mls. were rapidly added to the gelatin-halide solution and the remainder was added over a period of 22 minutes. Thereafter, the emulsion was ripened for 30 minutes at 55° C., with continuous agitation, at the end of which it was rapidly cooled to below 20° C.

Table 1

The following table summarizes the silver halide grain sizes obtained in the emulsion prepared above, all of which contained octahedral platelet crystals:

| Example | Polymer | Approximate Grain Size (microns) range | average |
|---|---|---|---|
| 8 | acrylamide/N,N-dimethylallylamine copolymer | 0.4–6.8 | 1.6 |
| 9 | acrylamide/N,N-dimethylallylamine copolymer | 0.4–4.8 | 2.0 |
| 10 | acrylamide/N,N-dimethylallylamine copolymer | 0.4–2.0 | 1.2 |
| 11 | acrylamide/N,N-dimethylallylamine copolymer | 0.5–3.0 | 1.2 |
| 12 | acrylamide/N-(2-chloroallyl)morpholine copolymer | 0.4–4.0 | 2.0 |
| 13 | acrylamide/N-(2-chloroallyl)piperidine | 0.4–3.8 | 2.0 |
| 14 | Acrylamide/methallylamine | 0.6–3.8 | 1.4 |
| 15 | Gelatin | 0.2–1.6 | 1.0 |

What is claimed is:

1. A photosensitive silver halide emulsion comprising silver halide crystals disposed in an emulsion binder comprising an allylamine copolymer having repeating units of the general formula:

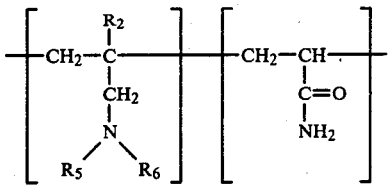

wherein $R_2$ is hydrogen, methyl, or chloro; and $R_5$ and $R_6$ are independently selected from hydrogen and methyl, or are chemically joined to form a 6 membered heterocyclic ring structure.

2. The photosensitive silver halide emulsion of claim 1 wherein the allylamine repeating unit of said copolymer is from an allylamine monomer selected from the group consisting of:

N,N-dimethylallylamine;

N-(2-chloroallyl) morpholine;

N-(2-chloroallyl) piperidine; and methallylamine.

3. The photosensitive silver halide emulsion of claim 2 wherein said monomer is N,N-dimethylallylamine.

4. The photosensitive silver halide emulsion of claim 2 wherein said monomer is N-(2-chloroallyl) morpholine.

5. The photosensitive silver halide emulsion of claim 2 wherein said monomer is N-(2-chloroallyl) piperidine.

6. The photosensitive silver halide emulsion of claim 2 wherein said monomer is methallylamine.

* * * * *